United States Patent [19]

Levake

[11] Patent Number: 5,046,387

[45] Date of Patent: Sep. 10, 1991

[54] STABILIZED, MULTIFUNCTIONAL TOOL HANDLE

[76] Inventor: Rodney D. Levake, 1100 N. Black Canyon, Stage 1, Phoenix, Ariz. 85027

[21] Appl. No.: 103,759

[22] Filed: Oct. 2, 1987

[51] Int. Cl.[5] ..... B25G 1/01

[52] U.S. Cl. ..... 81/489; 7/146; 7/166; 15/235.4; 15/235.5; 33/379

[58] Field of Search ..... 81/20, 22, 489–492; 7/146, 166; 15/235.4, 235.5, 235.6, 235.8; 33/334, 390, 379

[56] References Cited

U.S. PATENT DOCUMENTS

| | | | |
|---|---|---|---|
| 692,097 | 1/1902 | Wood | 33/379 |
| 1,490,220 | 4/1924 | Lawrence | 15/235.5 X |
| 2,076,836 | 4/1937 | Goldblatt | 15/235.4 X |
| 3,770,033 | 11/1973 | Gavillet et al. | 81/22 |
| 4,199,632 | 4/1980 | Travis | 81/20 |
| 4,332,046 | 6/1982 | Foley et al. | 7/146 |
| 4,418,732 | 12/1983 | Kolonia | 81/489 |

*Primary Examiner*—Brian W. Brown
*Attorney, Agent, or Firm*—James F. Duffy

[57] ABSTRACT

This disclosure has been directed to those parts of hand tools utilized in gripping and manipulating the tool, most frequently and generically: the handle. The handles are fabricated of water resistant materials, provided with ergonomic enhancing curves, equipped with stress resistant inserts, and made multifunctional to increase their usefulness and productive efficiency.

39 Claims, 4 Drawing Sheets

STABILIZED, MULTIFUNCTIONAL TOOL HANDLE

BACKGROUND

1. Field of the Invention

The invention relates to the field of hand tools which experience rough handling and are regularly subjected to high levels of moisture.

In particular the invention relates to means and method for extending the useful life of such tools under such conditions.

The invention further relates to tools used in the building trades wherein the need to level the work-in-progress is an important aspect of the job at hand.

2. Prior Art

The work performed by the professional home builder is often carried further by the owner or resident of the new home. Both the professional and the amateur, or occasional, craftsmen, have the same tools available to them. Yet, while the home-craftsman's tools seem to last forever, often being passed from father to son to son, the professional's tools frequently need to be replaced several times a year. This is especially true of tools used in cement and plaster work, as well as hand held tools.

Such tools when used almost daily by the professional will, of course, degrade faster than when given only infrequent use by the occasional craftsman. Tools infrequently used are subject to less rough usage than that experienced by tools of the professional craftsman. When used under conditions of high moisture, the occasionally used tool will generally be allowed to thoroughly dry before being subjected to wet usage again. However, when the professional uses his tools daily under such conditions, the tools get little opportunity to dry. Instead, water accumulates each day and penetrates deeper into the tool. The wood becomes rough and swells. The tool distorts and fastenings tend to pull away. Before too long, the professional craftsman must replace his tools in order to maintain the quality and quantity of his work.

This history of rapid deterioration of professionally used hand tools is especially true of tools used with concrete, cement, and plaster; as well as the wooden handles of hammers, hatchets, and the like.

Contributing to the frequent and inefficient handling to which such tools are subjected is the fact that they must be regularly set aside while the work is plumbed and/or leveled. Then the level, in-turn, is set aside and the tool taken up again.

The inventor is unaware of any prior art directed toward stabilizing and extending the useful lifetime of such tools used under such adverse conditions. Nor is he aware of any efforts to increase the efficiency of use of such tools when the need to frequently plumb and level the work is mandated. These will be seen to be objects of the present invention. The inventor is aware that women are entering the building trades in increasing numbers. His use herein of words such as craftsman, workman, and the like, are therefore to be taken as generic and not to imply gender, and to avoid the awkward his/her type of usage.

SUMMARY OF THE INVENTION

The invention is disclosed as means for increasing the working life, strengthening and stabilizing, and increasing the functionality of hand held tools employed in moisture rich working environments. The means for gripping and manipulating a tool, either a handle or the tool itself, is comprised of moisture resistant materials for an extended working lifetime in moisture rich environments such as induced by repeated handling of the tool or by the very nature of the work being performed.

In a preferred embodiment of the invention a bubble level is coupled to the gripping and manipulating means whereby a working surface, acted upon by a tool to which the gripping and manipulating means is a part, may be leveled. A light reflective surface coupled to the bubble level reflects light up through the level whereby the user is aided in establishing the position of the bubble within the level. The reflective surface is preferably a mirrored surface.

The gripping and manipulating means is disclosed in a preferred embodiment as having coupling means for coupling the gripping and manipulating means to any one of a variety of commercially available tools whereby the available tool may be upgraded for extended use in a moisture rich environment.

In one of the preferred embodiments, the coupling means comprises a slotted fastener—receptacle for the adjustably displaceable acceptance of a fastener whereby the gripping and manipulating means may be coupled by fasteners to any one of a variety of tools selected from the group of tools which comprises trowels, floats, and darbys.

The gripping and manipulating means is disclosed as comprising ergonomic enhancing contours to increase the efficiency of handling the gripping and manipulating means and the tool of which it may be a part. These contours may be supplemented with finger—grip contours to ergonomically enhance a craftsman's ability to grip the gripping and manipulating means and manipulate the tool.

In an alternative embodiment, the coupling means comprises a tang coupled to a first end of the gripping and manipulating means whereby the gripping and manipulating means may be coupled to the head of any one of a variety of tools selected from the group of tools comprised of hammers and axes. A side protuberance may be coupled to the gripping and manipulating means below the tang so that the bubble level may be utilized without reference to a surface on a tool head coupled to the tang. A preferred embodiment is disclosed in which a stress resistant insert extends through the tang and into the first end of the gripping and manipulating means. The stress resistant insert may comprise a steel insert.

It is preferred that the moisture resistant materials comprise laminated layers of wood and waterproof adhesive. The layers of wood may comprise alternating layers of birch and maple woods, or, alternatively, alternating layers of ash and bass woods. An alternative embodiment discloses that the moisture resistant materials may comprise water impervious plastic.

The invention is disclosed in one of its embodiments as means for increasing the working life, strengthening and stabilizing, and increasing the functionality of hand held tools, of the group of tools which comprise hammers and axes, which are subjected to high moisture conditions from repeated handling, the working environment, or both. The inventive means is disclosed as comprising a handle for gripping and manipulating a tool, the handle comprising moisture resistant materials for an extended working lifetime in moisture rich environments, and a stress resistant insert coupled to the handle through the length thereof for enabling the use of the handle as a pry bar.

In a first embodiment, the insert comprises a steel rod. Alternatively, the insert comprises an open-ended hollow tube whereby a user may insert a rod into the hollow tube to increase the leverage available when the handle is used as a pry bar. The tube is preferably a steel tube.

The moisture resistant materials are disclosed as comprising a plastic sheath about the insert. However, in a preferred embodiment, the moisture resistant materials comprise a wood sheath about the insert. The wood sheath is comprised of laminated layers of wood and waterproof adhesive. The layers of wood are disclosed as comprising alternating layers of birch and maple woods, or, alternatively, alternating layers of ash and bass woods.

DESCRIPTION OF THE DRAWINGS

FIG. 16 shows the use of a steel rod to strengthen the coupling of a handle to a hammer, axe, or the like.

DETAILED DESCRIPTION OF THE INVENTION

Figure 1:
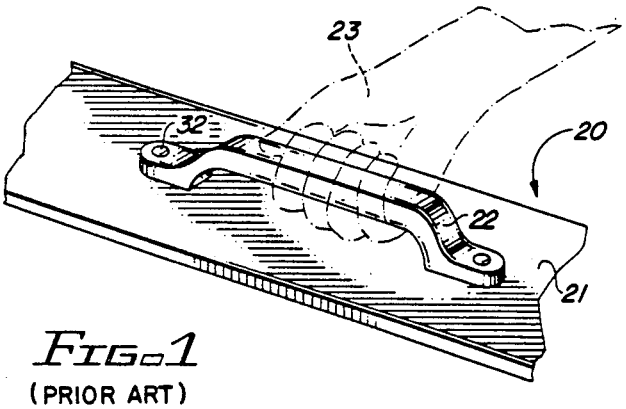
FIG. 1 (PRIOR ART)
FIG. 1 is a partial perspective drawing of a prior art, hand-held float used with wet cement or concrete.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention partains.

The invention developed in light of the conditions experienced by craftsmen in the building trades and the characteristics of the hand tools with which they ply their trade. Many of their tools are constructed of wood. And many of these wooden tools are continually subjected to high moisture conditions. The wooden handles of hammers and the like absorb perspiration from the hand of the craftsman. There is little time for this absorbed moisture to evaporate completely from the handle before the tool is again picked up and put to work again. Over a period of time, the handle becomes rough and abrasive to the hand due to the moisture-raised wood grain of the handle. In addition, if subjected to high levels of job site environmental moisture, the handle may split or break in two.

Other wood tools, employed by masons and plasterers and the like, are continually in contact with wet working materials. Within three or four months the handle means by which these tools are gripped and manipulated may warp and split. Where the handle is not an integral part of the tool, it may become so moisture damaged as to pull away from the fastenings by which it is attached to the tool. Masons and plasterers, actively employed in their trade, must frequently replace their floats, screed boards, and darbys three and four times a year.

This disclosure will present means and method for increasing the working life of tools by strengthening and stabilizing them for use in moisture rich environments, while also increasing their on-the-job functionality.

FIG. 1 illustrates a mason's float 20. The float is comprised basically of a base 21, regularly placed in contact with wet cement or concrete for use in working and leveling the surface thereof, and a handle 22 coupled to that base by means of fasteners 32. In keeping with attitudes within the trades which accept the need for frequent replacement of such tools, handle 22 and, often, base 21 are made from relatively inexpensive and relatively soft wood. While some consideration has been given to fabricating base 21 from metal to extend its working life, no such consideration appears to have been given the handle 22. And, in general, professional craftsmen prefer tool handles made of materials other than metal, demonstrating a preference for wood.

The handle of a readily, commercially available float absorbs water readily, distorts, and frequently splits such that fasteners 32 can no longer effect a restraining force, and base 21 and handle 22 become separated and unable to be rejoined. The handle of a commercially available float provides the means by which the float is gripped and manipulated. No means are provided to increase the efficiency with which a craftsman grips and manipulates the float. The upper surface is generally flattened. The lower surface is a part of a cylindrical section. The handle 22 is enveloped by the hand 23, shown in phantom outline. Handle 22 is short-lived, uncomfortable to use, and lacks room for enhancing its functionality.

Figure 2:
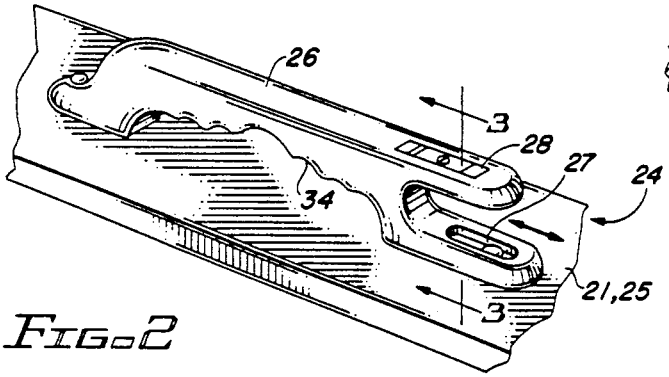
FIG. 2 is a partial perspective drawing of a float illustrating features of the teaching herein to stabilize the tool and add a bubble level to the handle.

An improved mason's float 24 is illustrated in FIG. 2. Float 24 may employ base 21, available to the prior art, and frequently made of metal. Alternatively, float 24 may utilize a base 25, fabricated in accord with the teachings herein. Base 25 is fabricated to remain stable under conditions of high moisture exposure. An adjunct to increased stability is increased strength and the ability to withstand frequent rough handling. The presently preferred manner of fabricating base 25 for increased strength and stability is indicated in cross section in FIG. 3.

Base 25 is preferably a bonded laminate of layers of wood and water resistant adhesives. In use on actual work sites, a laminate comprised of alternating layers of maple and birch woods found enthusiastic acceptance among the craftsmen and outperformed conventional floats. Tests of another laminate are planned: Bass is a wood which, because of the difficulties of curing it for use as lumber, finds frequent use in small-cross-sectional applications as, for example, its use in fabricating inexpensive rulers. It is a durable, light weight wood. Ash is a strong, straight grained wood which, it is believed will complement bass wood in a laminate to produce a strong, stable, light weight float.

Handle 26 of float 24 represents a further improvement. Handle 26 is not only stronger and more stable than its prior art counterpart, it also provides means for more efficiently gripping and manipulating the float. In addition, the functional capabilities of handle 25 are greater than the prior art handle 22.

Handle 26 is made stronger and more stable by casting it of metal or a shock resistant plastic. Alternately, and preferably, handle 26 is fabricated of layers of wood and water resistant adhesive in accord with the foregoing disclosure re base 25.

Handle 26 is ergonomically enhanced to increase its handling efficiency and to provide a more sure and comfortable grip for the hand. These advantages are achieved by means of contours 34 which conform the handle to the gripping contours of the hand and which also make provision for finger accomodating notches.

Figure 3:
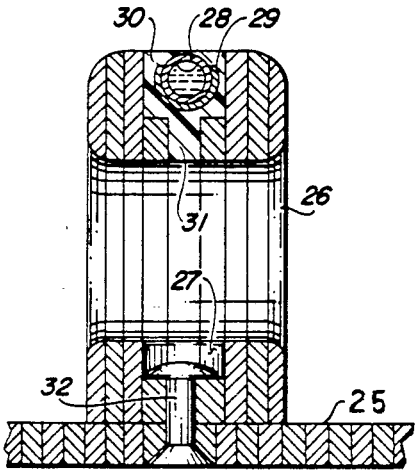
FIG. 3 is a section taken along 3—3 of FIG. 2.

Handle 25 has more functional uses than does prior art handle 22. In a first instance, fastening means 32, shown most clearly in the cross section of FIG. 3, is emplaced in a slot 27. Fastener 32 is selectedly displaceable along the length of slot 27. This feature allows a craftsman to replace a prior art handle 22, which may have been attached to a metal float base 21, with the improved handle 26. Since fastener 32 may be adjustably emplaced within slot 27, the fasteners affixing the handle to a float base may be positioned to accomodate fastening to a wide variety of commercially available bases.

In another instance of improved functionality, handle 25 is provided with an extension of its upper surface so as to accomodate the coupling thereto of a bubble level 28. Level 28 is emplaced so as to be clear of obscuring interference by the hand holding and manipulating handle 26. Note how the hand 23, indicated in phantom outline in FIG. 1, envelops most of the upper surface of prior art handle 22 and makes the addition of a bubble level thereto inefficient and impractical.

Experience indicates that the craftsman utilizing a tool incorporating a handle, such as handle 26 with bubble level 28 in place, soon develops an improved ability to maintain the tool essentially level while manipulating the tool in contact with the work surface. Relaxing the grip on the handle, with the hand remaining in its working position, permits the workman to verify that the surface being worked is indeed level or in need of further movement. Working efficiency is thereby increased since the workman need not release and put the tool aside so as to take up a separate leveling device to verify the quality of the workmanship.

It should be pointed out that a further improvement has been incorporated into the invention to enable the craftsman to rapidly determine that the work surface is properly leveled. As those familiar with the use of a bubble level are aware, it is frequently difficult to discern the location of the bubble within the level to make a determination that the bubble is centered and the work leveled To enhance the workman's ability to make this determination, and to further increase the efficiency of the invention, a light reflecting surface 29, FIG. 3, is emplaced below bubble level 28. This step significantly increases one's ability to make a rapid determination of the position of the bubble within the level. The enhancement is amplified if light reflecting surface 29 is a mirrored surface. The optical effect achieved is analogous to the audio enhancement derived by reproducing sound stereophonically. The bubble is detected and sited almost instantly. Viewing and positioning the bubble rapidly becomes an inherent part of the workman's manipulation of the tool.

Figure 4:
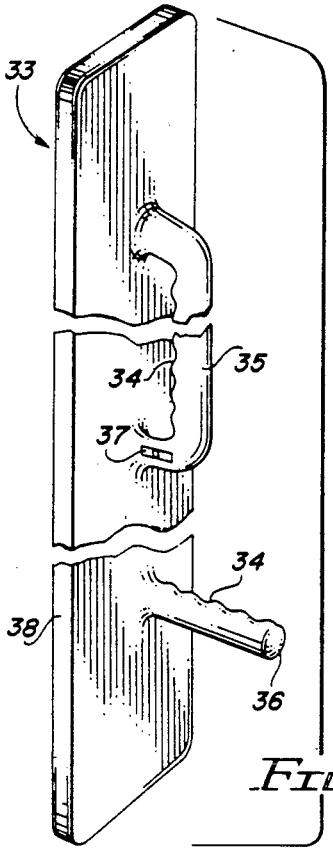
FIG. 4 illustrates a plaster's darby in accord with the teachings herein and having a bubble level for use in plumbing the surface of the work in progress FIG. 5 illustrated in partial perspective, is a mason's large, two-handed float in accord with the teachings herein and having a bubble level in the handle for use in leveling the surface of the work in progress.

The plasterer's darby 33, FIG. 4, is basically a long float. It is gripped and manipulated with two hands. Handles 35 and 36 are arrayed as indicated since the plasterer so frequently works at smoothing and plumbing the vertical surfaces of walls. Handle 36 provides a hand held support about which darby 33 may be pivoted by manipulation of the hand holding handle 35. To improve the efficiency with which handles 35 and 36 may be gripped and manipulated, both are provided with ergonomically enhancing hand and finger conforming contours 34.

Darby 33 is fabricated for long working life, strength, and stability In accord with the teachings earlier set forth with respect to float 25 and handle 26, FIGS. 2 & 3. Indeed, unless otherwise indicated, it is intended that these improvements will be incorporated in each of the tool embodiments set forth herein.

A bubble level 37 is coupled to handle 35. In practice, level 37 will be in a generally horizontal position while darby 33 is being utilized by a craftsman plastering a wall. It is emplaced to be perpendicular to the working surface of darby 33, i.e. the surface of base 38 that the plasterer places in contact with the wet plaster so that the plaster's finished surface will be smooth and plumb. When base 38 is positioned against the surface of a plaster coated wall and the bubble of level 37 is centered, the plastered surface is plumb.

Full advantage of the disclosed features of the back-up, light reflecting/mirrored surface 29 are taken. This is true of each of the invention's embodiments which includes a bubble level 28/37. The mirrored surface reflector is generally preferred because of the rapidity with which the workman adapts to its use and learns to make continual reference to it during the course of his work.

Both handles 34 and 35 are provided with ergonomically enhanced handling and manipulating contours 34. These conform to the workman's hands and fingers and contribute to increased working comfort and efficiency. As with the other improvements disclosed and intended for incorporation in the various embodiments of the invention, ergonomic contours 34 will be utilized to the greatest extent practical in each of those embodiments as well.

Figure 6:
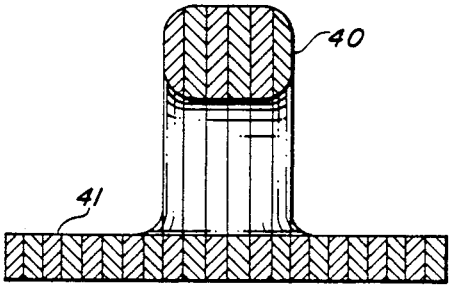
FIG. 6 is a section taken along 6—6 of FIG. 5.
Figure 5:
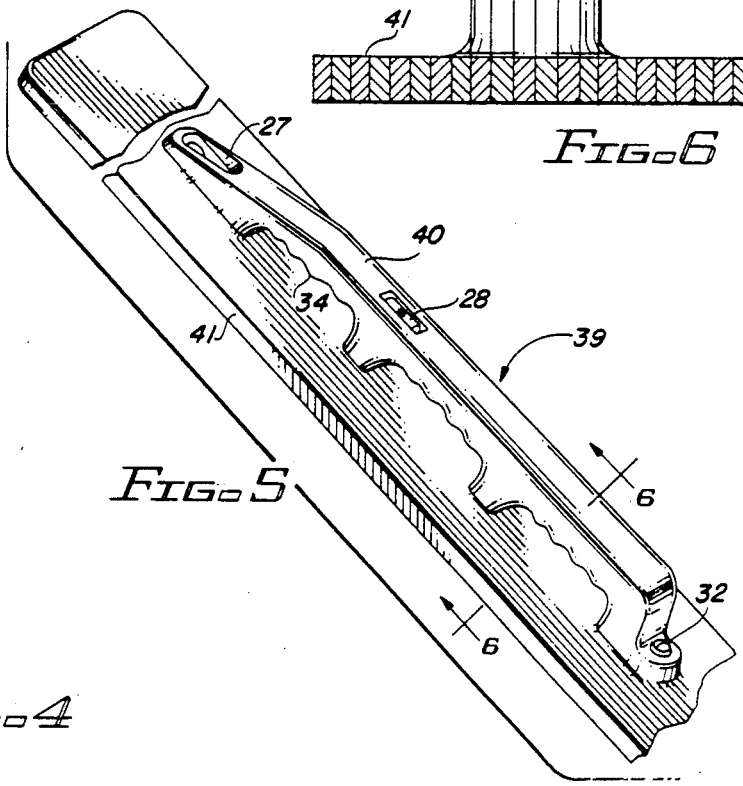

A mason's darby 39 is illustrated in FIG. 5. This, again, is basically an extended length float. It has a long handle 40 intended to be gripped and manipulated with two hands. Handle 40 includes the leveling features associated with level 28 and the adaptability provided by slot 27 which allows handle 40 to be fastened to any one of several commercially available mason's darby bases. FIG. 6, a cross section of the handle ,40 of darby 39 and its base 41, emphasizes that the disclosed and preferred structure for increasing working life, strengthening and stabilizing the tool have been utilized with mason's darby 39.

A mason uses a screed board to initially level an extensive surface of freshly laid cement or concrete, e.g. a walkway. In the screed board 42 depicted in FIG. 7, as in any such board, virtually the entire tool constitutes the gripping and manipulating means. It is therefore not that practical to include ergonomic contours in its design, although some advantage might be gained from the use of such contours in the vacinity of bubble level 28. By fabricating the board as a laminate construct 43, the strength, long life, and stability already disclosed become an inherent feature of screed 42.

With reference to FIG. 3, bubble level 28 and light reflective surface 29 are illustrated as being encapsulated in an optically transparent potting medium 30. Very satisfactory results have been achieved using a thermosetting plastic as the medium 30 for encapsulating. In a manner to be now disclosed, medium 30 is input through opening 31 so as to preclude the presence of bubbles from appearing within the cured potting medium 30 in regions that would obscure the sighting of level 28 (or 37, as appropriate ). The encapsulation technique will be disclosed with reference to the series of illustrations: FIGS. 8A–8D.

Figures 7, 8A, 8B, 8C, 8D, 9, 10:
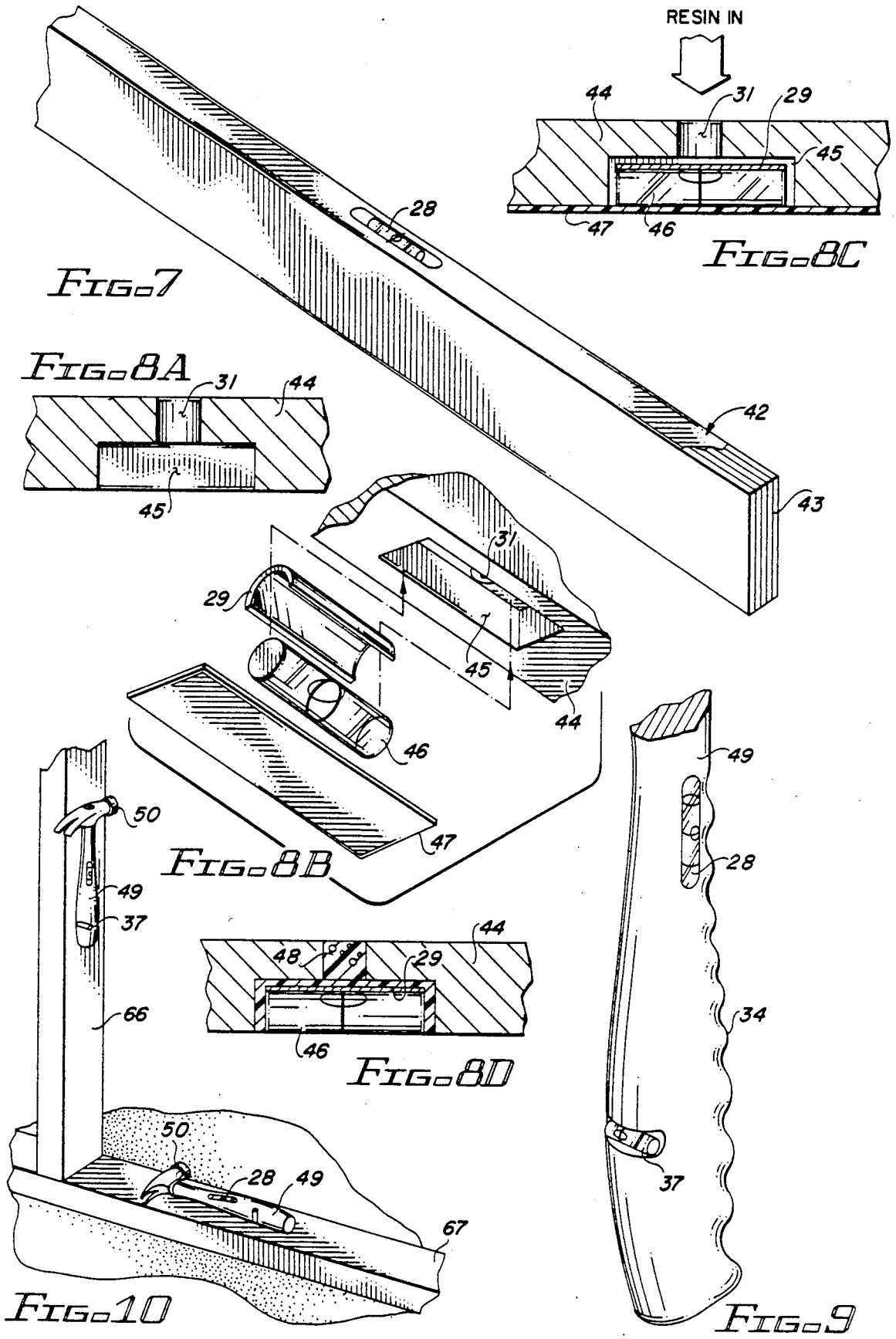
FIG. 7 is a partial perspective of a mason's screed board, fabricated per the teachings herein, and having a bubble level for use in leveling the work in progress.
FIGS. 8A-8D illustrate the manner in which a bubble level and a back-up, mirrored reflector are encapsulated within tools fabricated in accord with teachings herein.
FIG. 9 presents, in partial perspective, a handle, fabricated as instructed herein, for use with a hammer, or axe, or the like and having two bubble levels for use in plumbing and leveling work in progress.
FIG. 10 shows the use of a hammer, having the handle of FIG. 9, in plumbing and leveling wood framing in building construction work.

Refer first to FIG. 8A. A sectional view of a portion 44 of a tool is illustrated. A void 45 is created in tool section 44 through what will normally be the viewing surface of the tool into which a bubble level will be placed. From a generally opposing surface of tool section 44, a passageway 31 is placed to communicate with void 45.

In the exploded assembly drawing of FIG. 8B, it is seen that a bubble level element 46 is placed within the partial surround of reflective surface 29. Reflective surface 29 is preferably a mirrored surface and may be the surface of a thin, readily hand-formable strip of aluminum. The sub-assembly of reflector 29 and bubble element 46 are emplaced within void 45 and maintained there by closure element 47. Closure element 47 may be any material which can be employed satisfactorily to close off entry to or exit from void 45; and which has the added characteristic that the potting medium 48 will not adhere to it while the medium is curing.

The assembly is illustrated in FIG. 8C. Potting medium 48 will be injected into passageway 31, as indicated by the arrow marked "RESIN IN". Acting under the influence of gravity, the potting medium will move down into void 45 so as to completely encapsulate the sub-assembly of bubble element 46 and reflector 29. The presence of closure element 47 retains the potting medium in place within void 45 and passageway 31.

Once the potting medium has been poured, small bubbles entrained within the medium will tend to rise; floating upwards toward passageway 31 and away from bubble element 46. The result is shown in FIG. 8D. Bubbles tend to be suspended within the cured medium 48 within the region of passageway 31. No entrained bubbles are present in areas that will impede the viewing of the bubble level's bubble.

The task is completed by the removal of closure element 47 when potting medium 48 has fully cured.

As has been disclosed the gripping and manipulating means of the invention can take many forms. To this point, improvements in tools comprising the group of tools most frequently utilized by masons and plasterers have been discussed. The discussion will now be directed to tools which comprise the group of tools such as hammers, axes sledge hammers, etc.

The handle 49 of FIG. 9 will accomodate, for example, a hammer head. It is preferably structured as disclosed earlier with reference to FIG. 3. It is provided with ergonomic contours 34 as well as a bubble level 28. In addition, handle 49 is provided with a second bubble level 37. Levels 28 and 37 are positioned orthogonal to each other.

To appreciate the advantage attained with the introduction of two orthogonal bubble levels emplaced within a hammer handle, consider that level 28 was emplaced within handle 49 so that the level's bubble was centered when the hammer head 50 and handle 49 were placed flat on a horizontal surface 70, FIG. 10. Consider further that level 37 was emplaced within handle 49 such that the level's bubble was centered when the hammer head 50 and handle 49 were placed flat against a vertical surface 71, FIG. 10. Thereafter, the combination of hammer head 50 and handle 49 may be utilized by a craftsman to ascertain that a workpiece is level or plumb.

It is usual for a carpenter working on a construction site to verify that his work is plumb or level, as the case may be. To do so he must first put his hammer aside, find a level, use the level, place the level aside, pick up his hammer and return to work. A carpenter using a hammer having two orthogonal bubble levels, 28 and 37, emplaced within handle 49 can rapidly ascertain that his work is level/plumb without ever taking his hand away from his hammer. With the mirror backed bubble levels of the invention, the ability to ascertain level and plum so easily and rapidly soon induces the carpenter to verify level and plumb at more frequent intervals. The carpenter's workmanship improves in quality and time is saved.

Carpenters, like most craftsmen, develop favorites among the various types of tool the employ. This is true of hammer heads, which may have had several different handles attached to them during their course of association with a particular carpenter. The preceding discussion of FIGS. 9 and 10 required that handle 49 and hammer head 50 be united when the bubble levels 28 and 37 were first positioned within the handle. This was necessary since the contact point of the hammer head against a surface formed one of the reference points used to determine level/plum. If a new hammer head were to be placed on the handle the accuracy of the level and plumb determinations would be impaired.

Figure 11:
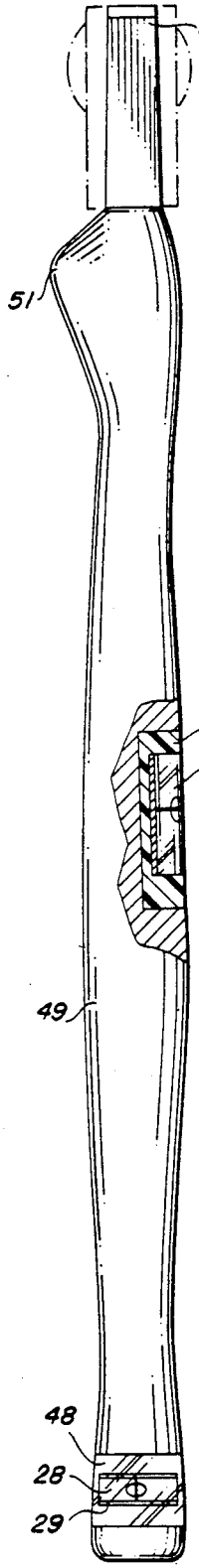
FIG. 11 shows a handle, with a side protuberance, suitable for use with any hammer head or the like and having two bubble levels encapsulated within the handle, one for leveling the workpiece, the other for plumbing it.
Figure 12:
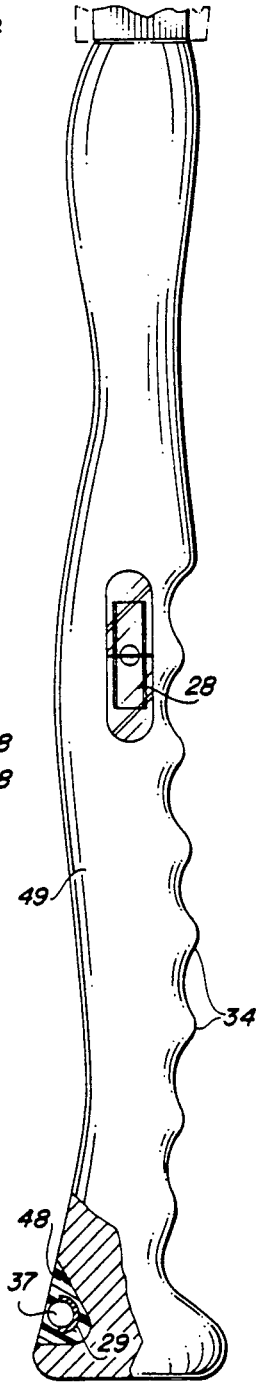
FIG. 12 is a side view of the leveling handle of FIG. 11.

In FIG. 11, a protuberance 51 has been added to one end of handle 49. Adjacent to protuberance 51 is a tang 64 which permits handle 49 to be coupled to any one of many different hammer heads. This combination of 51 and 64 allow a carpenter to place his own hammer head on handle 49 without damaging effect to the accuracy of the determination of level and plumb using levels 28 and 37 respectively.

Figure 13:
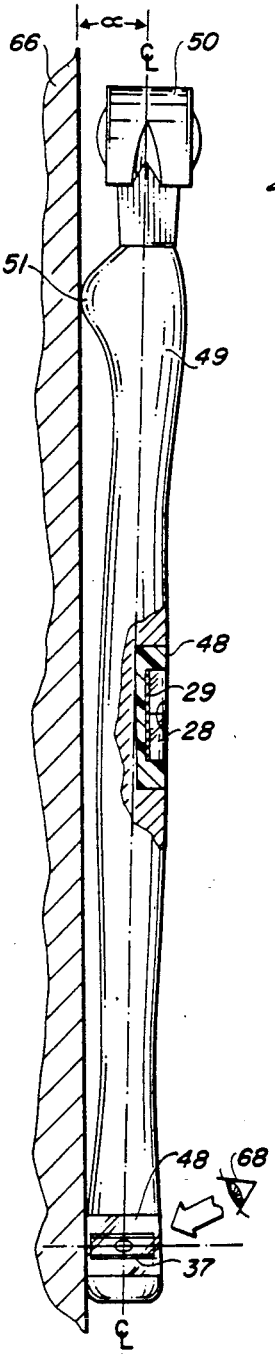
FIG. 13 illustrates the use of the leveling handle of FIG. 11 in plumbing a workpiece and shows the use of the side protuberance which permits the leveling handle to be used universally with any commercially available hammer head.

When handle 49, having protuberance 51 thereon, is placed against a vertical surface 66, FIG. 13, the centerline through handle 49 forms an acute angle with surface 66. This is because protuberance 51 raises the hammer head 50 away from surface 66. Thus, hammer head 50 is not used as a reference contact point in either the determination of level or plumb.

Figure 14:
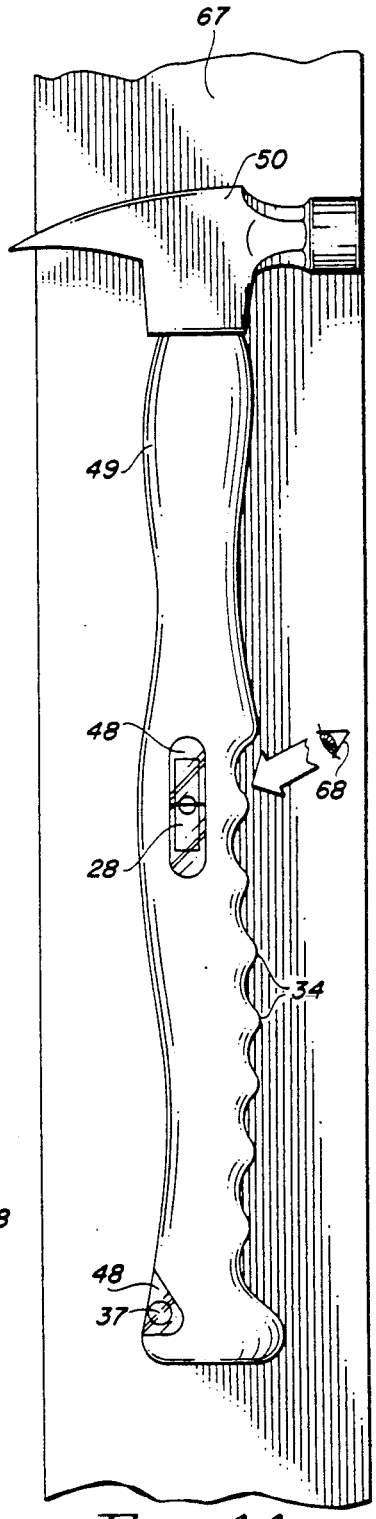
FIG. 14 demonstrates the manner in which the leveling handle is used to establish the level of a workpiece.

Note that although the centerline through handle 49 forms an acute angle with surface 66, level 28 has been so emplaced within handle 49 that it lies parallel to surface 66. And level 37 has been so emplaced as to be orthogonal to that surface. In FIG. 13 a view is taken, as indicated at 68, to determine whether surface 66 is plumb. In FIG. 14 a view is taken, again as indicated at 68, to determine whether surface 67, upon which the hammer is lying, is level.

Figure 15:
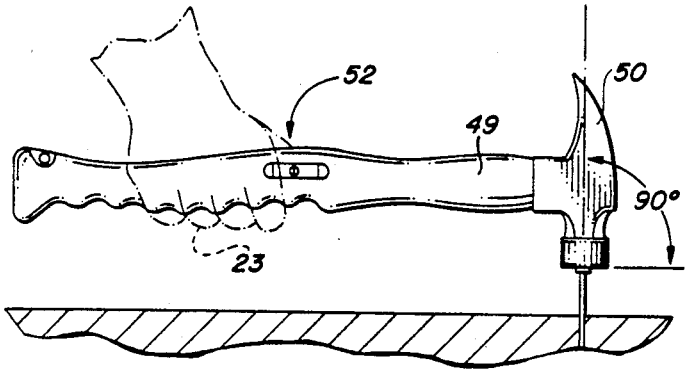
FIG. 15 illustrates the effect of a slightly curved handle which allows the hammer head to strike perpendicular to the nail head while the hand holding the handle remains at a normal, slightly uptilted angle.

The drawings of FIGS. 11 through 14 are of large size and clearly illustrate the encapsulation of levels 28 and 37 and reflectors 29 by means of potting compound 48 within handle 49. In addition to the ergonomic contours 34 to achieve a more efficient gripping and manipulation of handle 49, the handle itself is curved. This feature, as indicated in FIG. 15, allows the user's hand to remain at a comfortable, slightly uptilted angle as the hammer head 50 impacts a nail at an angle orthogonal to the nail head. The force applied to the nail is more apt to be fully directed along the shaft of the nail with the results that fewer hammer blows are required to drive the nail home; more nails are driven within a given time; and, the carpenter's arm is subjected to less shock and strain.

Figure 16:
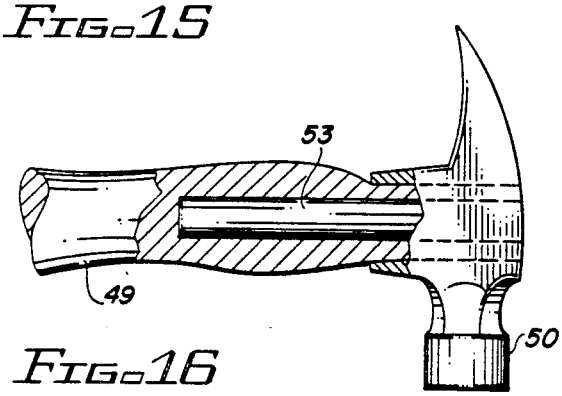

The coupling of hammer head 50 to handle 49 may be done so as to significantly increase the strength of the union. As illustrated in FIG. 16, a shock resistant insert 53 extends into handle 49 from the top of head 50. Insert 53 extends beyond the base of head 50 into handle 49. Most frequently a hammer handle will break at the juncture of the base of the head and the handle. The propensity for retaining hammer heads and the like on a handle by means of a wood-splitting wedge driven into the top of the handle after the head is in place only increases the tendency for the handle to break at its juncture with the head.

Figure 17:
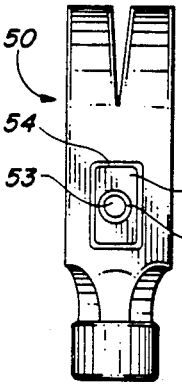
FIG. 17 is a detail of the coupling arrangement of FIG. 16.

In addition to the strengthening insert 53, the invention discloses a manner of coupling the head and hammer and insert which contributes no weakening stresses to the union. FIG. 17 shows the insert 53 retained within a bore within handle 49 by a strong adhesive, such as epoxy. The head 50 is retained in place on handle 49 by another, similar adhesive bond. Head, handle, and insert are all effectively chemically welded together. No stress risers are introduced.

Sledge hammers often are inverted by the laborers using them so as to use the handles as pry bars. (See FIG. 19.) The handles are frequently broken by such mistreatment. Though it is an acknowledged bad practice, the practice continues nonetheless. Recognizing the inevitable, yet seeking to prevent the breakage of handles, a stress resistant insert (an extension of insert 53, FIG. 16) through the length of the handle of a sledge hammer is disclosed in FIG. 18.

Figure 18:
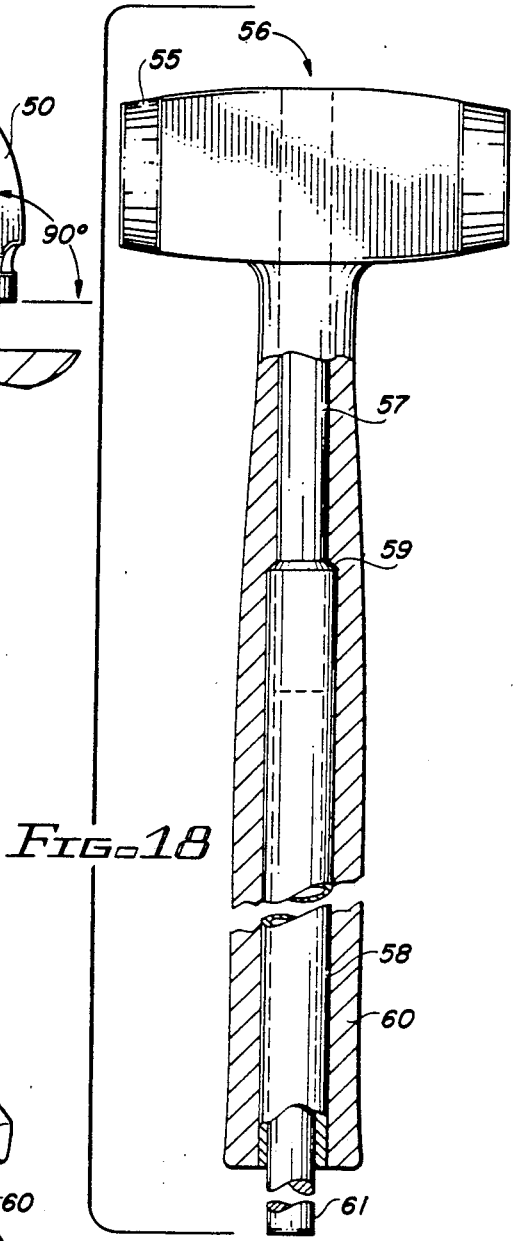
FIG. 18 depicts an alternative assembly of a steel-shanked handle for use with a sledge hammer.
Figure 19:
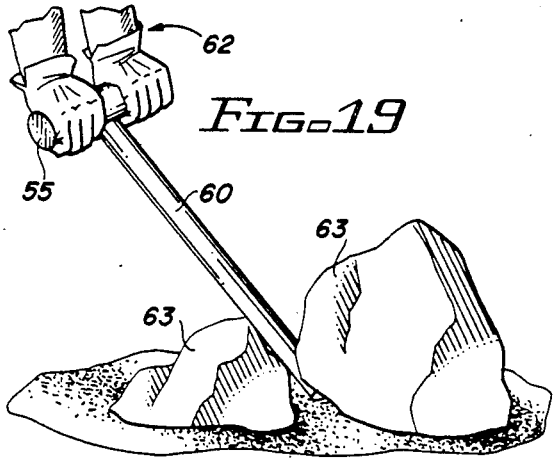
FIG. 19 illustrates the use of the sledge handle of FIG. 18 as a pry bar.

The stress resistant insert 56 may be a steel rod 57 extending throughout the entire length of handle 60. Alternatively, stress resistant insert 56 may be a length of steel tubing 58 which extends throughout handle 60. Or as depicted in FIG. 18, insert 56 may be a combination of both a rod 57 and a tube 58. The rod 57 and the tube 58 can be readily coupled together as by means of weldment 59.

Figure 20:
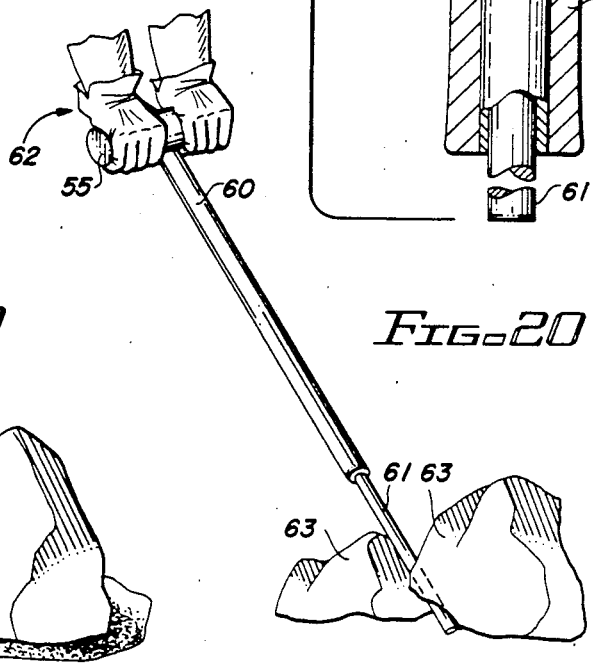
FIG. 20 indicates the manner in which a steel rod extension may be inserted into the handle of FIG. 18 to extend the reach of the handle and to increase leverage when the handle is used as a pry bar.

If Tube 58 extends all the way through handle 60, or occupies the lower regions thereof, as depicted in FIG. 18, an added advantage derives. A length of rod 61, available independently, may be inserted into tube 58 in sledge handle 60 to be used as the prying element, as seen in FIG. 20, instead of submitting handle 60 itself to the damaging effects of such practice. The insertion of rod 61 into tube 58 provides the laborer 62 with an extension of handle, allows him to extend his reach, and provides greater leverage.

This disclosure has been directed to those parts of hand tools utilized in gripping and manipulating the tool, most frequently and generically: the handle. The handles are fabricated of water resistant materials, provided with ergonomic enhancing curves, equipped with stress resistant inserts, and made multifunctional to increase their usefulness and productive efficiency.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, THAT WHICH IS CLAIMED IS:

1. Means for increasing the working life, strengthening and stabilizing, and increasing the functionality of hand held tools employed in moisture rich working environments comprising:

means for gripping and manipulating a tool, said means comprising moisture resistant materials for an extended working lifetime in moisture rich environments;

bubble means coupled to said gripping and manipulating means whereby a workpiece, acted upon by a tool to which said gripping and manipulating means is a part may be leveled;

a light reflective surface coupled to said bubble level to reflect light up through the level whereby the user is aided in establishing the position of the bubble within the level;

said light reflective surface comprising a mirrored surface;

said gripping and manipulating means further comprising coupling means for coupling said gripping and manipulating means to any one of a variety of commercially available tools whereby said available tool may be upgraded for extended use in a moisture rich environment;

said coupling means comprises a tang coupled to a first end of said gripping and manipulating means whereby said gripping and manipulating means may be coupled to the head of any one of a variety of tools selected from the group of tools which comprises; hammers and axes; and a side protuberance coupled to said gripping and manipulating means below said tang whereby said bubble level may be utilized without reference to a surface on a tool head coupled to said tang.

2. The means of claim 1 wherein said gripping and manipulating means further comprises ergonomic enhancing contours to increase the efficiency of handling the gripping and manipulating means and the tool of which it may be a part.

3. The means of claim 2 wherein said contours further comprise finger—grip contours to ergonomically enhance a craftsman's ability to grip said gripping and manipulating means and manipulate the tool of which it may be a part.

4. The means of claim 1 further comprising a stress resistant insert extending through said tang and into said first end of said gripping and manipulating means.

5. The means of claim 4 wherein said stress resistant insert comprises a steel insert.

6. The means of claim 5 wherein said gripping and manipulating means further comprises ergonomic enhancing contours to increase the efficiency of handling the gripping and manipulating means and the tool of which it may be a part.

7. The means of claim 6 wherein said contours further comprise finger—grip contours to ergonomically enhance a craftsman's ability to grip said gripping and manipulating means and manipulate the tool of which it may be a part.

8. The means of claim 1 wherein said moisture resistant materials comprise laminated layers of wood and waterproof adhesive.

9. The means of claim 8 wherein the layers of wood comprise alternating layers of birch and maple woods.

10. The means of claim 8 wherein the layers of wood comprise alternating layers of ash and bass woods.

11. The means of claim 1 wherein said moisture resistant materials comprise water impervious, plastic.

12. Means for increasing the working life, strengthening and stabilizing and increasing the functionally of hand held tools, of the group of tools which comprise hammers and axes, subjected to high moisture conditions from repeated handling, the working environment, or both, comprising:

a handle for gripping and manipulating a tool, said handle comprising moisture resistant materials for an extended working lifetime in moisture rich environments;

bubble means coupled to said handle whereby a workpiece, acted upon by a tool to which said handle is a part, may be leveled;

a tang coupled to a first end of said handle whereby said handle may be coupled to the head of any one of a variety of tools selected from the group of tools which comprises hammers and axes; and a side protuberance coupled to said handle below said tang whereby said bubble level may be utilized without reference to a surface on a tool head coupled to said tang.

13. The means of claim 12 further comprising a light reflective surface coupled to said bubble level to reflect light up through the level whereby the user is aided in establishing the position of the bubble within the level.

14. The means of claim 13 wherein said reflective surface comprises a mirrored surface.

15. The means of claim 12 further comprising:

a tang coupled to a first end of said handle whereby said handle may be coupled to the head of any one of a variety of tools selected from the group of tools which comprises hammers and axes; and a side protuberance coupled to said handle below said tang whereby said bubble level may be utilized without reference to a surface on a tool head coupled to said tang.

16. The means of claim 15 further comprising a light reflective surface coupled to said bubble level to reflect light up through the level whereby the user is aided in establishing the position of the bubble within the level.

17. The means of claim 16 wherein said reflective surface comprises a mirrored surface.

18. The means of claim 15 further comprising a stress resistant insert extending through said tang and into said first end of said gripping and manipulating means.

19. The means of claim 18 wherein said stress resistant insert comprises a steel insert.

20. The means of claim 19 wherein said handle further comprises ergonomic enhancing contours to increases the efficiency of handling and manipulating the tool off which it may be a part.

21. The means of claim 20 wherein said contours further comprise finger-grip contours to ergonomically enhance a craftsman's ability to grip said handle and manipulate the tool of which it may be a part.

22. The means of claim 21 wherein said moisture resistant materials comprise laminated layers of wood and waterproof adhesive.

23. The means of claim 22 wherein the layers of wood comprise alternating layers of birch and maple woods.

24. The means of claim 22 wherein the layers of wood comprise alternating layers of ash and bass woods.

25. The means of claim 22 wherein said moisture resistant materials comprise laminated layers of wood and waterproof adhesive.

26. The means of claim 25 wherein the layers of wood comprise alternating layers of birch and maple woods.

27. The means of claim 25 wherein the layers of wood comprise alternating layers of ash and bass woods.

28. The means of claim 26 wherein said handle further comprises ergonomic enhancing contours to increase the efficiency of handling and manipulating the tool of which it may be a part.

29. The means of claim 28 wherein said contours further comprise finger-grip contours to ergonomically enchance a craftsman's ability to grip said handle and manipulate the tool of which it may be a part.

30. The means of claim 15 wherein said moisture resistant materials comprise laminated layers of wood and waterproof adhesive.

31. The means of claim 30 wherein the layers of wood comprise alternating layers of birch and maple woods.

32. The means of claim 30 wherein the layers of wood comprise alternating layers of ash and bass woods.

33. Means for increasing the working life, strengthening and stabilizing, and increasing the functionality of hand held tools employed in moisture rich working environments comprising:

means for gripping and manipulating a tool, said means comprising moisture resistant ;materials for an extended working lifetime in moisture rich environments;

bubble means coupled to said gripping and manipulating means whereby a workpiece, acted upon by a tool to which said gripping and manipulating means is a part, may be leveled;

said gripping and manipulating means further comprises coupling means for coupling said gripping and manipulating means to any one of a variety of commercially available tools whereby said available tool may be upgraded for extended use in a moisture rich environment;

said coupling means comprises a tang coupled to a first end of said gripping and manipulating means whereby said gripping and manipulating means may be coupled to the head of any one of a variety of tools selected form the group of tools which comprises hammers and axes; and a side protuberance coupled to said gripping and manipulating means below said tang whereby said bubble level may be utilized without reference to a surface on a tool head coupled to said tang.

34. The means of claim 33 further comprising a light reflective surface coupled to said bubble level to reflect light up through the level whereby the user is aided in establishing the position of the bubble within the level.

35. The means of claim 34 wherein said reflective surface comprises a mirrored surface.

36. The means of claim 35 further comprising a stress resistant insert extending through said tang and into said first end of said gripping and manipulating means.

37. The means of claim 36 wherein said stress resistant insert comprises a steel insert.

38. The means of claim 37 wherein said gripping and manipulating means further comprises ergonomic enhancing contours to increase the efficiency of handling the gripping and manipulating means and the tool of which it may be a part.

39. The means of claim 38 wherein said contours further comprise finger-grip contours to ergonomically enhance a craftsman's ability to grip said gripping and manipulating means and manipulate the tool of which it may be a part.

* * * * *